US006533550B1

(12) United States Patent
Mills

(10) Patent No.: US 6,533,550 B1
(45) Date of Patent: Mar. 18, 2003

(54) BLADE RETENTION

(75) Inventor: Daniel Mills, Chateauguay (CA)

(73) Assignee: Pratt & Whitney Canada Corp., Quebec (CA)

( * ) Notice: Subject to any disclaimer, the term of this patent is extended or adjusted under 35 U.S.C. 154(b) by 0 days.

(21) Appl. No.: 10/002,917

(22) Filed: Oct. 23, 2001

(51) Int. Cl.[7] ..... F01D 5/32
(52) U.S. Cl. ..... 416/220 R; 416/221; 416/248
(58) Field of Search ..... 416/220 R, 221, 416/204 A, 248

(56) References Cited

U.S. PATENT DOCUMENTS

| | | | | |
|---|---|---|---|---|
| 2,751,189 A | | 6/1956 | Ledwith | |
| 2,873,088 A | | 2/1959 | Neumann | |
| 3,137,478 A | | 6/1964 | Farrell | |
| 3,309,058 A | | 3/1967 | Blackhurst et al. | |
| 4,255,086 A | * | 3/1981 | Roberts | 416/218 |
| 4,280,795 A | | 7/1981 | Trousdell | |
| 4,349,318 A | * | 9/1982 | Libertini et al. | 416/220 R |
| 4,523,890 A | | 6/1985 | Thompson | |
| 4,566,857 A | * | 1/1986 | Brumen | 416/220 R |
| 4,580,946 A | | 4/1986 | Bobo | |
| 5,302,086 A | * | 4/1994 | Kulesa et al. | 416/221 |

FOREIGN PATENT DOCUMENTS

| | | |
|---|---|---|
| FR | 998221 | 1/1952 |

* cited by examiner

*Primary Examiner*—Ninh Nguyen
(74) *Attorney, Agent, or Firm*—Bachman & LaPointe, P.C.

(57) ABSTRACT

A blade retaining system for securing rotor blades to a rotor disc used in gas turbine engines includes an inwardly radially extending annular groove defined in the periphery of the rotor disc, intersecting the "fir tree" mounting slots into which the rotor blades are mounted. A resilient split ring is received in both the annular groove of the rotor disc and a groove defined in the bottom end of the root portion of each blade, in order to restrain axial movement of the blade relative to the rotor disc. The resilient split ring under its radial expanding spring force, radially and outwardly abuts the rotor blades and is radially spaced apart to ensure the engagement in both the grooves of the rotor disc and each rotor blade, while permitting disengagement therefrom when required. The resilient split ring is disposed downstream of the cooling air inlets in the bottom end of each rotor blade to direct the cooling air into the inlets in order to facilitate the blade cooling air circulation. The blade retaining structure is simple to manufacture and maintain.

17 Claims, 3 Drawing Sheets

BLADE RETENTION

FIELD OF THE INVENTION

The present invention relates to a rotor assembly of gas turbine engines, and more particularly, to a blade retention structure for securing rotor blades to a rotor disc used in gas turbine engines.

BACKGROUND OF THE INVENTION

The turbine or compressor construction of certain gas turbine engines has a dynamically balanced rotor assembly which generally includes alloy blades attached to a rotating disc. The base of each blade is usually of a so-called "fir tree" configuration to enable it to be firmly attached to the periphery of the disc and still have room for thermal expansion. The "fir tree" attachment of a rotor blade to the rotor disc is effective in restraining the radial and circumferential movements of the rotor blades, relative to the rotor disc, against radial centrifugal forces. However, during high speed, high temperature operation of the gas turbine engine, the axial flow of air or gas through the rotor assembly exerts a constant axial force on the rotor blades so as to bias the blade roots axially, relative to the "fir tree" slots in the periphery of the rotor disc. In order to restrain the blades against the axial force, both forwardly and rearwardly, it has been common practice to employ various pinning and bolting systems, including wound and crimped wires for connecting the blade roots to the rotor disc. However, in the continuous high speed operation of a as turbine engine, and the high thermal gradients developed in the components of a turbine, threaded fasteners may tend to loosen after time, potentially resulting in relative movement between the components and possible damage to the rotor assembly. In addition, the provision of bolts about the periphery of the rotor disc could cause dynamic unbalancing of the overall assembly, which could also create problems during high speed, high temperature operation.

Efforts have been made to provide boltless blade retaining structures. U.S. Pat. No. 4,349,318, issued to Libertini describes a relatively complicated blade retaining assembly including a continuous wire-type retainer, a generally cylindrical retaining plate and a split retainer ring. Annular grooves or recesses are machined out of the rotor disc and the roots of the rotor blades for accommodating the individual retaining elements.

In addition to the integrity of the attachment, minimizing the loss of cooling air from air-cooled turbine blade delivery circuits is often an important design consideration. Typically, cooling air is directed into the hollow blade through a clearance between a bottom end of the blade root and the bottom of a "fir tree" slot of the rotor disc. Various sealing structures have been developed to impede leakage through the "fir tree" channel and improve the cooling performance of rotor blades, but opportunities for improvement remain.

Therefore, there is a need for both improved blade retaining structures and cooling air sealing structures for rotor assemblies used in gas turbine engines.

SUMMARY OF THE INVENTION

One object of the present invention is to provide a simpler blade retaining structure for securing rotor blades to a rotor disc used in a gas turbine engine.

Another object of the present invention is to provide a blade retaining structure which improves cooling air circulation in the rotor blades.

A still further object of the present invention is to provide a method of axially retaining rotor blades in a rotor disc.

In accordance with one aspect of the present invention, a blade retaining structure is provided for retaining a plurality of gas turbine engine rotor blades on a rotor disc, the disc having an axis, a circumference, a periphery and a plurality of circumferentially-spaced mounting slots defined in the periphery, the plurality of rotor blades each having a root portion configured to be slidingly received in the disc mounting slots, the system comprising: a first annular groove defined radially inwardly in the periphery of the rotor disc and extending along the disc circumference, the annular groove intersecting the plurality of mounting slots; a set of second grooves defined in a bottom end of the root portion of the plurality of rotor blades, the set of second grooves discontinuously extending around the rotor disc circumference when the blades are installed thereon and substantially axially aligning and co-operating with the first annular groove to provide a ring passage; and a resilient split ring member adapted to be mounted around the rotor disc and received in the ring passage, the split ring member and ring passage adapted to restrain axial movement of the rotor blades relative to the rotor disc when the split ring member is disposed in the ring passage.

In accordance with another aspect of the present invention, a rotor assembly for use in a gas turbine engine, the assembly comprising: a rotor disc having an axis, a circumference, a periphery, a plurality of circumferentially-spaced mounting slots defined in the periphery, and a first annular groove, the first annular groove defined radially inwardly in the periphery of the rotor disc and extending along the disc circumference, the annular groove intersecting the plurality of mounting slots; a plurality of rotor blades each having a root portion configured to be slidingly received in one of the disc mounting slots, each of said blades having a blade groove defined in a bottom end of the root portion thereof, the plurality of blade grooves co-operating to form a set of second grooves which discontinuously extend around the rotor disc circumference when the blades are installed on the disc, the second set of grooves substantially axially aligning and co-operating with the first annular groove to provide a ring passage; and a resilient split ring member adapted to be mounted around the rotor disc and received in the ring passage, the split ring member and ring passage adapted to restrain axial movement of the rotor blades relative to the rotor disc when the split ring member is disposed in the ring passage.

In accordance with a further aspect of the present invention, a blade retainer is provided for retaining a plurality of gas turbine engine rotor blades to a rotor disc, the disc having an axis, a circumference, a periphery, a plurality of circumferentially-spaced mounting slots defined in the periphery, and a first annular groove defined radially inwardly in the periphery of the rotor disc and extending along the disc circumference, the annular groove intersecting the plurality of mounting slots, the plurality of rotor blades each having a root portion configured to be slidingly received in the disc mounting slots, the plurality of rotor blades collectively having a set of second grooves defined in a bottom end of the root portion of each rotor blade, the set of second grooves discontinuously extending around the rotor disc circumference when the blades are installed thereon and substantially axially aligning and co-operating with the first annular groove to provide a ring passage, the blade retainer comprising: a resilient split ring member adapted to be mounted around the rotor disc and received in the ring passage, the split ring member adapted to be received in the ring passage to restrain axial movement of the rotor blades relative to the rotor disc.

In accordance with a yet further aspect of the present invention, a turbine blade is provided for use in conjunction with a turbine blade retaining system for retaining said blade to a rotor disc assembly, the assembly including a disc and a resilient split ring member, the disc having an axis, a circumference, a periphery, a plurality of circumferentially-spaced mounting slots defined in the periphery, a first annular groove defined radially inwardly in the periphery of the rotor disc and extending along the disc circumference, the annular groove intersecting the plurality of mounting slots, the resilient split ring member disposed around the rotor disc in the first annular groove, the turbine blade comprising: a tip portion; and a root portion extending from the tip portion, the root portion configured to be slidingly received in the disc mounting slots and having a second groove defined in a bottom end of the root portion, the second groove positioned and adapted to substantially axially align and co-operate with the split ring member when installed in the mounting slot on the rotor disc so that the split ring member is disposed in the second groove and engages the blade to restrain axial movement of the blade relative to the rotor disc The present invention provides a simple blade retaining system which is relatively easy to manufacture and maintain. Other advantages and features of the present invention will be better understood with reference to the preferred embodiments described hereinafter.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENT

Figure 1:
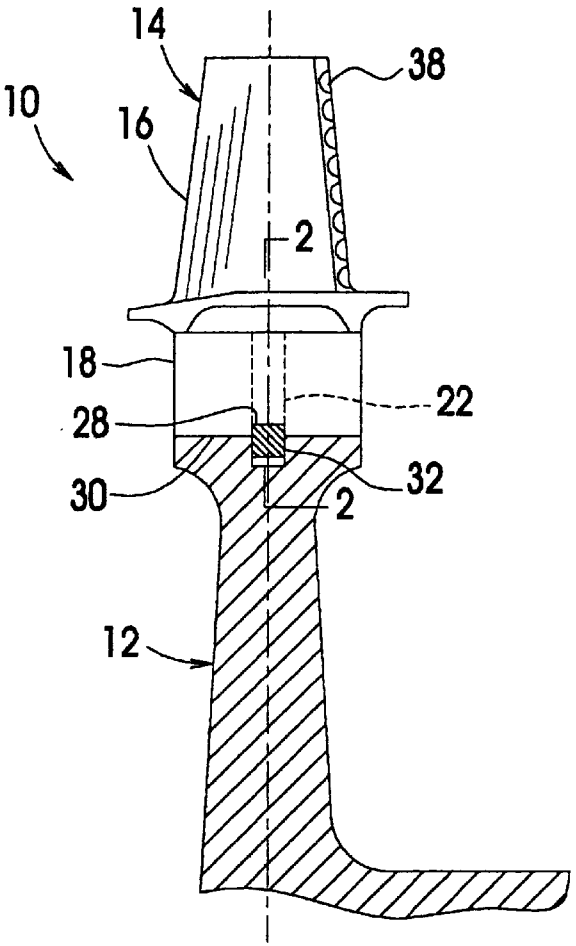
FIG. 1 is a partial cross-sectional side view of a rotor assembly of a gas turbine engine, incorporating the present invention.

Referring to FIG. 1, a rotor assembly of the subject invention, generally designated by numeral 10, is intended to be employed as a turbine rotor in a gas turbine engine. However, the present invention could be applied to a compressor rotor of a gas turbine engine. The rotor assembly 10 basically includes a rotor disc 12 and a plurality of rotor blades 14 which are releasably mounted to the rotor disc 12.

Figure 2:
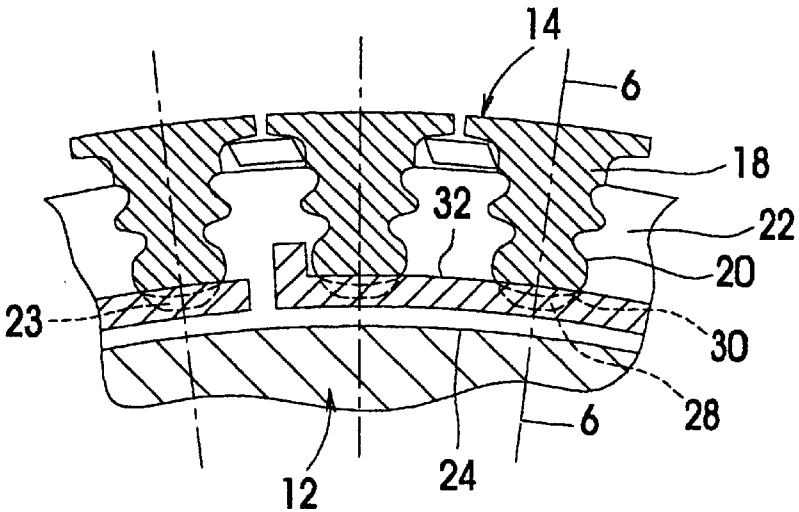
FIG. 2 is a partial cross-sectional view of the rotor assembly of FIG. 1 taken along line 2—2, showing the attachment of root portions of the rotor blades to the rotor disc.

Each rotor blade 14 includes an airfoil section 16 and a root portion 18 of a conventional "fir tree" configuration, as more clearly shown in FIG. 2, which is adapted to be accommodated within one of similarly configured mounting slots 20. The mounting slots 20 are circumferentially spaced apart and are defined in the periphery of the rotor disc 12. An annular groove 22 is defined in the periphery of the rotor disc 12 and extends into the periphery around its circumference. The annular groove 12 intersects the generally axially oriented mounting slots 20, as more clearly shown in FIGS. 4 and 5, in which numerals 24 and 26 indicate the respective bottoms of the mounting slots 20 and the annular groove 22. The annular groove 22 has a depth generally equal to the depth of the mounting slots 20 (see FIG. 4) according to one embodiment of the present invention. Alternatively, the depth of the annular groove 22 is greater than the depth of the mounting slots 24 (see FIG. 5) according to another embodiment of the present invention. However, the mounting slots 20 could also be deeper than the annular groove 22 (not shown). The depth relationship between the annular groove and the mounting slots will be further discussed with reference to FIGS. 6 and 7 hereinafter.

Referring to FIGS. 1, 2, 6 and 7, the root portion 18 of each rotor blade 14 includes a groove 28 defined in the bottom end 30 thereof. The groove 28 in each blade 14 is positioned so that the grooves discontinuously circumferentially extend (see FIG. 2) and axially align with the annular groove 22 of the rotor disc 12 (see FIGS. 6 and 7) when the blades 14 are installed to define a passage. The grooves align and the passage is formed so that a resilient split ring 32 can be received in the passage defined by the annular groove 22 of the rotor disc 12 and the groove 28 of the root portion 18 of each rotor blade 14. Thus, the radial and circumferential movement of rotor blades 14 relative to the rotor disc 12 is restrained by the "fir tree" configured mounting slots 20 of the rotor disc 12, and the axial movement of the rotor blades 14 relative to the rotor disc 12 is restrained by the resilient split ring 32. The groove 28 is preferably slightly concavely arcuate and thereby adapted to evenly receive the resilient split ring 32 along the length of the groove 28.

Figure 3:
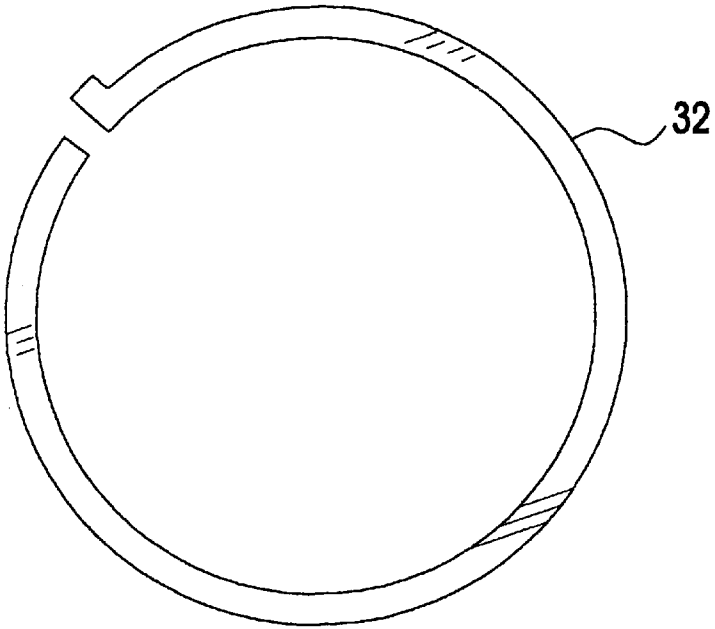
FIG. 3 is a side elevational view of a resilient split ring used in blade retention.

The resilient split ring 32 is illustrated in FIG. 3 and has a dimension such that it can be forcibly opened to receive the rotor disc 12 therein, and thus fit into the annular groove 22 of the rotor disc 12, as shown in FIG. 1. The resilient split ring 32 is also adapted so that, when it fits in the passage defined by the annular groove 22 of the rotor disc 12 and the respective rotor blades are mounted to the rotor disc 12, the resilient split ring 32, resiliently abuts a bottom surface 34 of the groove 28 in the root portion 18 of each rotor blade 14 to ensure its engagement in both the annular groove 22 and the groove 28. The resilient split ring 32 generally can be of any type and have any cross-section, however, it preferably has parallel side surfaces. The ring 32 of this embodiment is similar to a commonly known piston ring.

Figure 7:
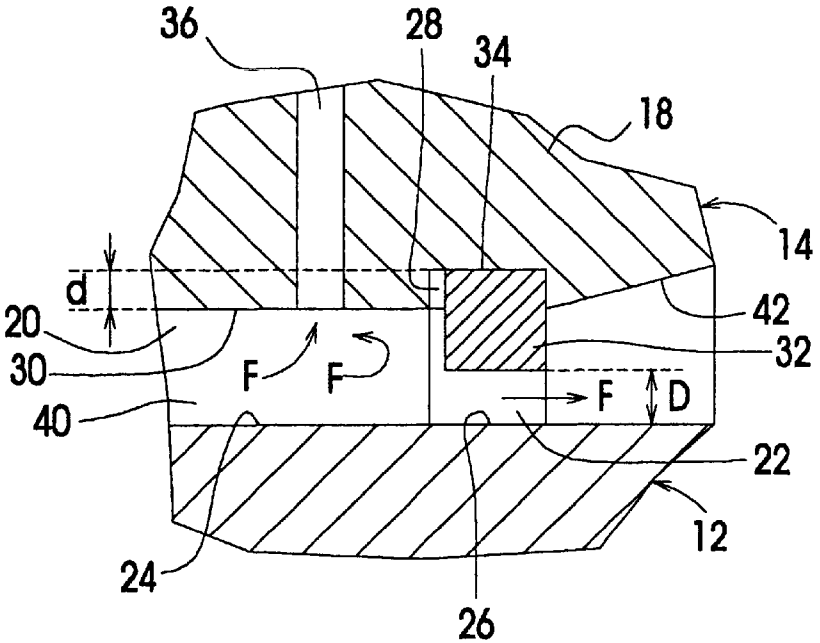
FIG. 7 is a view similar to FIG. 6, showing the resilient split ring partially blocking the cooling air passage.
Figure 6:
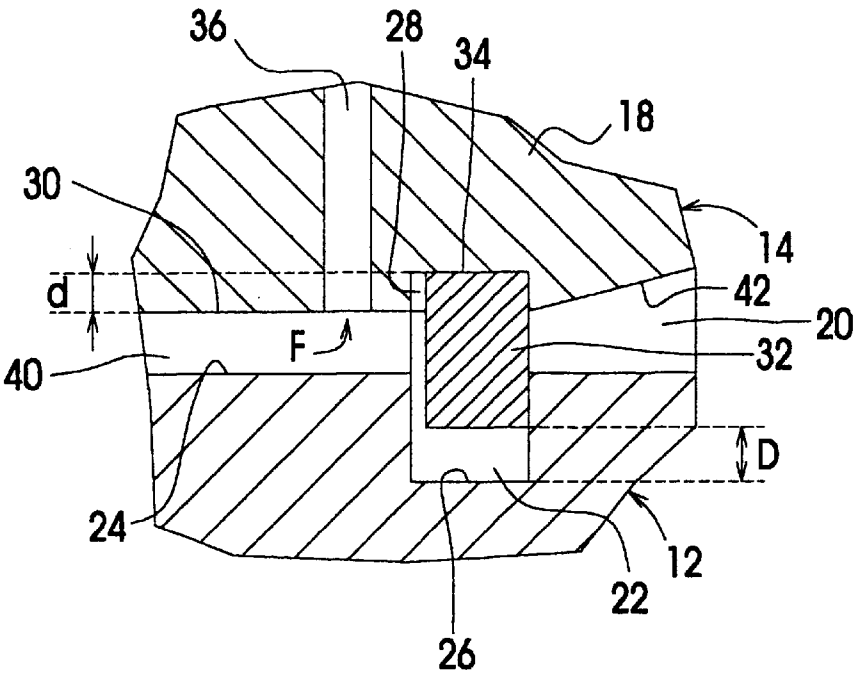
FIG. 6 is a partial cross-sectional view of FIG. 2, taken along line 6—6, showing the resilient split ring blocking a cooling air passage between the bottom end of the root portion of the rotor blade and the bottom of the corresponding mounting slot.

The rotor blade 14 has a hollow configuration including an internal cooling air passage (not shown, but as is well known in the art) extending therethrough to circulate cooling air flow to cool the airfoil section 16 (see FIG. 1) of the rotor blade 14. The inner internal air passage generally includes cooling air inlets 36 (see FIGS. 6 and 7) in the bottom end 30 of the root portion 18 of the rotor blade 14, and cooling air outlets 38 on the trailing edge of the airfoil section 16 of the rotor blade 14 (see FIG. 1). As is known, cool air diverted from the compressor can be fed through the passage to cool the airfoil. Referring to FIG. 7, a cooling air feed passage 40 is formed between the bottom end 30 of the root portion 18 of the rotor blade 14 and the bottom 24 of the mounting slots 20 of the rotor disc 12. A portion of the cool air diverted from the compressor and provided to feed passage 40 enters the cooling air inlets 36. As can be determined from an examination at FIG. 6, if ring 32 were not present (as in the prior art), a portion of the cooling air flow in air passage 40 would escape through the rotor assembly. As seen in FIG. 6, however, ring 32 blocks passage 40, inhibiting leakage. The resilient split ring 32 can thus improve the air flow circulation of the air foil sections 16 of the rotor blades 14 when the annular groove 22 of the rotor disc 12 and the grooves 28 in the root portions 18 of the respective rotor blades 14 are both positioned downstream (relative to the cooling air flow) of the cooling inlets 36. The resilient split ring 32 can partially (see FIG. 7), or completely (see FIG. 6) block the air passages 40 and directs the cooling air flows (indicated by arrows F) into the air cooling inlets 36. This aspect is described further below.

Still referring to FIGS. 6 and 7, the resilient split ring 32 is radially spaced apart from the bottom end 26 of the annular groove 22 of the rotor disc 12 at a distance D while abutting the bottom 34 of the groove 28 in the root portion 18 of the blade 14. The space D must be greater than the depth d of the groove 28 in the root portion 18 of the rotor blade 14 in order to allow the resilient split ring 32 at any point of its periphery, to be pressed radially inwardly for disengagement from the groove 28 in the root portion 18 of the rotor blade 14 adjacent to the pressed point. This facilitates blade insertion and removal. An angled guiding surface 42 may be provided at the bottom end 30 of the root portion 18 of the rotor blade 14 at one side for facilitating insertion of the resilient split ring 32 into the groove 28 of the root portion 18 of the rotor blade 14.

Figure 5:
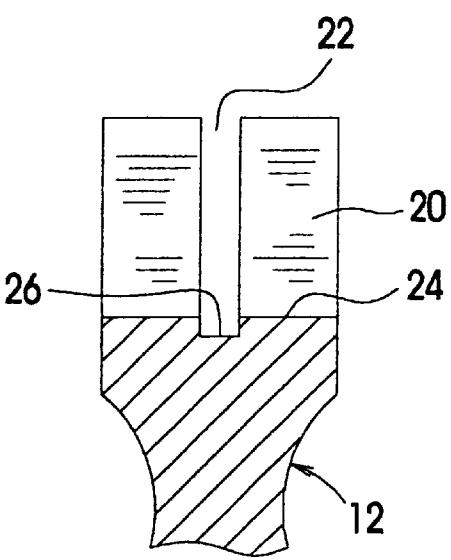
FIG. 5 is a partial cross-sectional view of the rotor disc, showing the relationship between the annular groove and the mounting slots according to another embodiment of the present invention.
Figure 4:
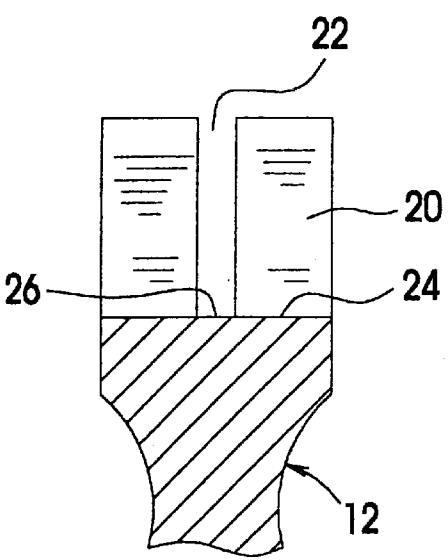
FIG. 4 is a partial cross-sectional view of the rotor disc, showing the relationship between the annular groove and the mounting slots according to one embodiment of the present invention.

Resilient split ring 32 can advantageously substantially block the air passage 40 by either partially or completely blocking the passage. When the annular groove 22 and the mounting slots 20 of the rotor disc 12 have a generally equal depth, as shown in FIG. 4 and FIG. 7, the resilient split ring 32 only partially blocks the air passage 40 because the space D is needed for the disengagement of the resilient split ring 32. However, when the annular groove 22 is deeper than the mounting slots 20 of the rotor disc 12 as shown in FIG. 5 and FIG. 6, it is possible to use the resilient split ring 32 to completely block the air passage 40 and direct all of the cooling air flow F into the cooling air inlets 36 in the root portion 18 of the rotor blade 14. This provides design options according to different cooling requirements. It is acceptable for the blade retention system that the mounting slots 20 are deeper than the annular groove 22 if the requirement that space D be greater than depth d, is met. Nevertheless, this configuration provides less space to adjust the distribution of cooling air flows between entering the inlets 36 and passing though the passage 40.

In order to assemble the rotor assembly 10, as shown in FIG. 1, the resilient split ring 32 is forcibly opened and is placed in the annular groove 22 of the rotor disc 12. Each rotor blade 14 slides into a mounting slot 20 of the rotor disc 12 while the resilient split ring 32 is radially and inwardly pressed down by a tool or by the angled guiding surface 42 (shown in FIGS. 6 and 7) until the resilient split ring 32 is clicked into position in the groove 28 of the root portion 18 of the rotor blade 14. When the disassembly of the rotor blades 14 from the rotor disc 12 is required, a tool such as a thin rod can be inserted between two adjacent rotor blades 14 to press down the resilient split ring 32 radially and inwardly to the bottom 26 of the annular groove 22 and then, the adjacent blades 14 can be slidingly removed from their mounting slots 20.

Changes and modifications to the embodiments of the present invention described above may be made without departing from the spirit and the scope of the present invention which are intended to be limited only by the scope of the appended claims.

I claim:

1. A blade retaining system for retaining a plurality of gas turbine engine rotor blades on a rotor disc, the disc having an axis, a circumference, a periphery and a plurality of circumferentially-spaced mounting slots defined in the periphery, the plurality of rotor blades each having a root portion configured to be slidingly received in the disc mounting slots, the system comprising:

a first annular groove defined radially inwardly in the periphery of the rotor disc and extending along the disc circumference, the annular groove intersecting the plurality of mounting slots;

a set of second grooves defined in a bottom end of the root portion of the plurality of rotor blades, the set of second grooves discontinuously extending around the rotor disc circumference when the blades are installed thereon and substantially axially aligning and co-operating with the first annular groove to provide a ring passage; and a resilient split ring member adapted to be mounted around the rotor disc and received in the ring passage, the split ring member and ring passage adapted to restrain axial movement of the rotor blades relative to the rotor disc when the split ring member is disposed in the ring passage.

2. A blade retaining system as claimed in claim 1 wherein the split ring is adapted to radially outwardly abut and bias the roots of the respective blades when the system is assembled.

3. A blade retaining system as claimed in claim 2 wherein the bottom of the root portion of each rotor blade includes an angled surface adapted to facilitate engagement of the rotor blades with the split ring member.

4. A blade retaining system as claimed in claim 1 wherein the split ring member is radially spaced apart from a bottom of the ring passage when disposed in the ring passage.

5. A blade retaining system as claimed in claim 4 wherein the split ring member is adapted to releasably disengage at least one retained blade when the split ring member is forced radially inwardly, said disengagement permitting said at least one blade to be slidingly removed from its mounting slot.

6. A blade retaining system as claimed in claim 1 wherein the annular groove is substantially equal in depth to the mounting slots.

7. A blade retaining system as claimed in claim 1 wherein the depth of the annular groove is greater than the depth of the mounting slots.

8. A blade retaining system as claimed in claim 1 wherein the split ring member substantially blocks an axial flow passage defined between the bottom end of the root portion of the rotor blades and their corresponding mounting slot.

9. A blade retaining system as claimed in claim 1 wherein the ring passage is positioned downstream of a cooling air inlet located in the bottom end of the rotor blades when the system is assembled.

10. A rotor assembly for use in a gas turbine engine, the assembly comprising:

a rotor disc having an axis, a circumference, a periphery, a plurality of circumferentially-spaced mounting slots defined in the periphery, and a first annular groove, the first annular groove defined radially inwardly in the periphery of the rotor disc and extending along the disc circumference, the annular groove intersecting the plurality of mounting slots;

a plurality of rotor blades each having a root portion configured to be slidingly received in one of the disc mounting slots, each of said blades having a blade groove defined in a bottom end of the root portion thereof, the plurality of blade grooves co-operating to form a set of second grooves which discontinuously extend around the rotor disc circumference when the blades are installed on the disc, the second set of grooves substantially axially aligning and co-operating with the first annular groove to provide a ring passage; and a resilient split ring member adapted to be mounted around the rotor disc and received in the ring passage, the split ring member and ring passage adapted to restrain axial movement of the rotor blades relative to the rotor disc when the split ring member is disposed in the ring passage.

11. A rotor assembly as claimed in claim 10 wherein the split ring member is adapted to releasably disengage at least one retained blade when the split ring member is forced radially inwardly, said disengagement permitting said at least one blade to be slidingly removed from its mounting slot.

12. A rotor assembly as claimed in claim 10 wherein the split ring member substantially blocks an axial flow passage defined between the bottom end of the root portion of the rotor blades and the corresponding mounting slot.

13. A blade retaining system as claimed in claim 10 wherein the ring passage is positioned downstream of a cooling air inlet located in the bottom end of each rotor blade.

14. A blade retainer for retaining a plurality of gas turbine engine rotor blades to a rotor disc, the disc having an axis, a circumference, a periphery, a plurality of circumferentially-spaced mounting slots defined in the periphery, and a first annular groove defined radially inwardly in the periphery of the rotor disc and extending along the disc circumference, the annular groove intersecting the plurality of mounting slots, the plurality of rotor blades each having a root portion configured to be slidingly received in the disc mounting slots, the plurality of rotor blades collectively having a set of second grooves defined in a bottom end of the root portion of each rotor blade, the set of second grooves discontinuously extending around the rotor disc circumference when the blades are installed thereon and substantially axially aligning and co-operating with the first annular groove to provide a ring passage, the blade retainer comprising:

a resilient split ring member adapted to be mounted around the rotor disc and received in the ring passage, the split ring member adapted to be received in the ring passage to restrain axial movement of the rotor blades relative to the rotor disc.

15. A turbine blade for use in conjunction with a turbine blade retaining system for retaining said blade to a rotor disc assembly, the assembly including a disc and a resilient split ring member, the disc having an axis, a circumference, a periphery, a plurality of circumferentially-spaced mounting slots defined in the periphery, a first annular groove defined radially inwardly in the periphery of the rotor disc and extending along the disc circumference, the annular groove intersecting the plurality of mounting slots, the resilient split ring member disposed around the rotor disc in the first annular groove, the turbine blade comprising:

a tip portion; and a root portion extending from the tip portion, the root portion configured to be slidingly received in the disc mounting slots and having a second groove defined in a bottom end of the root portion, the second groove positioned and adapted to substantially axially align and co-operate with the split ring member when installed in the mounting slot on the rotor disc so that the split ring member is disposed in the second groove and engages the blade to restrain axial movement of the blade relative to the rotor disc.

16. A turbine blade as claimed in claim 15 wherein the bottom of the root portion of the rotor blade includes an angled surface adapted to facilitate engagement of the rotor blade with the split ring member.

17. A turbine blade as claimed in claim 16 wherein the groove of the rotor blade is concavely arcuate to evenly engage the resilient split ring.

* * * * *